US007448179B2

(12) United States Patent
Schieffer

(10) Patent No.: US 7,448,179 B2
(45) Date of Patent: Nov. 11, 2008

(54) REBAR REINFORCED MASONRY WALL SYSTEM AND METHOD

(75) Inventor: Douglas D Schieffer, Farmington, MN (US)

(73) Assignee: Northland Concrete & Masonry, Burnsville, MN (US)

( * ) Notice: Subject to any disclaimer, the term of this patent is extended or adjusted under 35 U.S.C. 154(b) by 653 days.

(21) Appl. No.: 10/835,477

(22) Filed: Apr. 28, 2004

(65) Prior Publication Data

US 2005/0257459 A1 Nov. 24, 2005

(51) Int. Cl.
*E04B 1/00* (2006.01)

(52) U.S. Cl. ..... 52/745.21; 52/426; 52/712; 52/379

(58) Field of Classification Search ..... 52/426, 52/726.1, 301, 169.9, 415, 436, 300, 506.1, 52/474, 745.21, 712, 655.1, 378, 379, 513; 256/19

See application file for complete search history.

(56) References Cited

U.S. PATENT DOCUMENTS

| | | | | | |
|---|---|---|---|---|---|
| 2,358,867 | A | | 9/1944 | Madan | |
| 2,627,176 | A | | 2/1953 | Levy | |
| 3,362,280 | A | | 1/1968 | Muller | |
| 3,406,443 | A | | 10/1968 | DeRidder | |
| 3,415,552 | A | | 12/1968 | Howlett | |
| 3,693,310 | A | * | 9/1972 | Middleton | 52/685 |
| 3,854,371 | A | | 12/1974 | Lamothe | |
| 4,012,806 | A | * | 3/1977 | Howie, Jr. | 16/441 |
| 4,095,389 | A | | 6/1978 | Outram et al. | |
| 4,117,643 | A | | 10/1978 | Lamothe | |
| 4,143,986 | A | | 3/1979 | Antosh | |
| 4,202,378 | A | * | 5/1980 | Bush et al. | 138/96 R |
| 4,619,096 | A | * | 10/1986 | Lancelot, III | 52/726.1 |
| 4,694,863 | A | * | 9/1987 | Klopp | 138/96 R |
| 4,726,567 | A | * | 2/1988 | Greenberg | 256/19 |
| 5,004,282 | A | * | 4/1991 | Perry | 294/16 |
| 5,152,118 | A | | 10/1992 | Lancelot | |
| 5,253,386 | A | * | 10/1993 | LaLonde | 15/206 |
| 5,308,184 | A | | 5/1994 | Bernard | |

(Continued)

OTHER PUBLICATIONS

Dayton/Richmond Concrete Accessories, Mechanical Reinforcement Connection System, Dowel Bar Splicer System catalog, pp. 1-3 and 15.

*Primary Examiner*—Richard E. Chilcot, Jr.
*Assistant Examiner*—Mark R Wendell
(74) *Attorney, Agent, or Firm*—Merchant & Gould PC

(57) ABSTRACT

A reinforced masonry wall system includes a foundation and layers of masonry block having aligned vertical openings formed therein. Base reinforcing members are set in the foundation and extend upright at a height approximately the same as the height of a masonry block. Covers are placed on the upper ends of the placed reinforcement members to protect the reinforcement members from falling mortar. The wall is built over the base reinforcement members. When additional vertical members are attached, the cover is removed and the ends of the reinforcing member are cleaned. An elongated reinforcing member is inserted through the aligned openings of the masonry blocks and connected to the previously attached reinforcing member. The process can be repeated to construct a wall of increased height with the reinforcing members connected in an end-to-end configuration. Tools are provided for removing the cover, cleaning the ends of the reinforcing member and tightening the newly placed reinforcing member while avoiding lifting blocks several feet over elevated vertically extending reinforcement members.

37 Claims, 4 Drawing Sheets

U.S. PATENT DOCUMENTS 5,355,647 A 10/1994 Johnson et al.
5,379,562 A 1/1995 Hohmann
5,523,043 A * 6/1996 Kassardjian et al. ..... 264/273
5,533,419 A 7/1996 Adler
5,729,952 A 3/1998 Dahl
5,890,332 A 4/1999 Skidmore et al.
5,943,836 A 8/1999 Kassardjian
5,946,871 A 9/1999 Kassardjian et al.
5,967,638 A * 10/1999 Gorman et al. ..... 362/84
6,195,955 B1 3/2001 Kostopoulos
D442,051 S * 5/2001 Rines ..... D8/88
6,347,916 B1 2/2002 Ramirez
6,557,316 B2 5/2003 Van Der Heijden
6,571,452 B1 6/2003 Wang

* cited by examiner

REBAR REINFORCED MASONRY WALL SYSTEM AND METHOD

BACKGROUND OF THE INVENTION

1. Field of the Invention

The present invention relates to a masonry wall system and method of construction and in particular to a rebar reinforced masonry wall system and construction method.

2. Description of the Prior Art

Masonry block walls are well known and such walls have been built for centuries. Such walls are generally constructed by providing a foundation and then stacking blocks, which are attached to one another with a mortar material that hardens when set. Such conventional techniques are well known and widely used.

Greater structural integrity is needed for all building types supported by concrete masonry units (CMUs) and in some areas so that stronger walls are needed with improved reinforcement. Systems and construction techniques have been developed that provide stronger reinforced walls. One conventional technique utilizes rebar reinforcing systems having overlapping structural members extending through openings in the masonry block. Such rebar systems form grids that provide reinforcement to commonly used materials, such as concrete core fill.

While rebar reinforcement systems achieve greater wall strength over non-reinforced systems, construction techniques are more difficult with rebar reinforcement systems. Conventional rebar systems and installation techniques have vertical reinforcement elements that are set into the foundation and extend up about four feet. Heretofore, it has been necessary to lift the masonry block over the upper end of the rebar and slide the block down while building up the wall. Lifting the heavy blocks up and over the upper end of the rebar elements adds time, requires additional work for masons, and is a safety hazard.

Reinforcing members have been developed for concrete structures that threadably connect. A problem with building up and over an exposed threaded end of a reinforcing member is that mortar often may fall onto the exposed threaded portion of the reinforcing member. When the wall has been built to several feet above the exposed end and mortar may fall onto the threaded portion. Cleaning of the threads has not been done, as the threaded portion may be several feet away from the upper end of the wall and beyond the normal reach of the construction workers.

It can be seen then that a new and improved system for building a reinforced masonry block wall is needed. Such a system should provide satisfactory strengthening and reinforcement of the wall with rebar type reinforcing elements. Such a system should also eliminate the safety concerns and avoid the added work and strain placed on the construction workers due to lifting masonry block up and over the vertical reinforcing members. A system would have further utility if it prevented fouling from mortar material that may fall onto the exposed threaded ends of the reinforcing member. The present invention addresses these as well as other problems associated with reinforced masonry walls and their construction.

SUMMARY OF THE INVENTION

The present invention is directed to a system and method for constructing a reinforced masonry block wall. A conventional masonry wall sets on a foundation and includes masonry blocks. The blocks are preferably offset between adjacent layers to form the wall. The blocks bond to one another with mortar using conventional building techniques and materials.

The present invention utilizes a reinforcement system, such as rebar, to strengthen the wall. Unlike conventional rebar systems wherein vertical members are placed in the foundation and extend upward the equivalent of several layers of masonry block with the wall being built over the elements, the present invention utilizes a base reinforcing element that is embedded in the foundation and preferably sticks up to a height approximately the same as the overall height of a single masonry block. The rebar base member may be "L" shaped and anchored into the concrete foundation. The upper end of the base member has a threaded end that couples to a complementary reinforcement member that extends through several levels of block. In addition, the reinforcing system may be increased in height by connecting additional complementary reinforcing members in an extended top-to-bottom configuration, thereby increasing the overall height of the reinforcing system.

The construction method of the present invention utilizes a cover that is placed over each exposed end of a reinforcement member. The wall may then be built above the reinforcing member without lifting up and over a rebar member extending up and out of the wall. The cover intercepts mortar that may otherwise fall on the reinforcing member so that the threads on the end of the reinforcing member remain clean. The wall is then built with additional layers being added until reaching a height approximately the same as the height of the reinforcing system when an additional elongate reinforcing member is attached.

A long handled tool is utilized to remove the cover. In a preferred embodiment, the tool is configured so that it can be inserted into the aligned vertical openings of the masonry blocks to grasp and lift the cover member from the reinforcement member. In addition, a tool having a long handle may be inserted through the aligned vertical openings to clean the end of the threads of the reinforcing member if needed. In one embodiment, the tool includes a brush having wire bristles extending radially inward to engage the periphery of the reinforcing member.

An elongated complementary reinforcing member is then inserted through the several layers of masonry blocks into the aligned openings in the layers of masonry blocks and is twisted on. The elongated member preferably has a complementary end that threadably connects to the upper end of the already attached reinforcing member. This process can be repeated for several reinforcing members to form an extended reinforcing system. In this manner, the wall is built without having to lift the blocks over a reinforcing member that extends substantially above the top of the partially completed wall. In addition, the cover can be removed and the ends can be cleaned without having to reach downward. A wall can be built with several layers being added and additional reinforcement members connected. In rebar reinforced masonry walls, the vertical spaces are filled with a suitable fill material, such as concrete core fill.

To aid in tightening the reinforcement members onto the already placed reinforcement members, a gripping tool may be utilized that has an end portion configured for tightening around a reinforcing rebar member. The tool also includes a grip portion and may have a lock and adjustment feature.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

DETAILED DESCRIPTION OF THE PREFERRED EMBODIMENT

Figure 1:
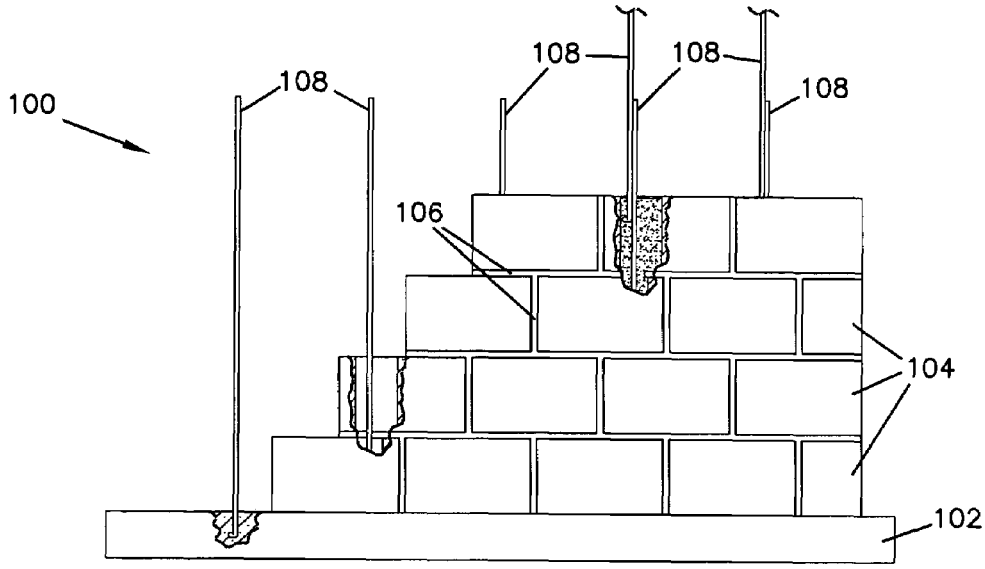
FIG.1 PRIOR ART
FIG. 1 is a front elevational view of prior art masonry wall construction.

Referring now to the drawings, and in particular to FIG. 1, there is shown a prior art masonry block wall system, generally designated 100. The wall system 100 is made by conventional methods and using conventional reinforcement. The wall 100 generally includes a foundation 102 and masonry blocks 104, also commonly referred to as concrete masonry units (CMUs), stacked in a conventional manner to form the masonry wall 100. Between the masonry blocks 104 is mortar 106 that bonds the masonry blocks 104 relative to one another and results in a cohesive wall structure 100. In addition, reinforcement members 108 extend vertically through the wall 100 and are embedded into the foundation 102. Although the wall 100 may provide reinforcement and greater strength than walls that are not reinforced, the blocks must still be placed over the elevated upper end of the reinforcement members 108, adding additional labor, time and strain for the masonry worker.

Figure 2:
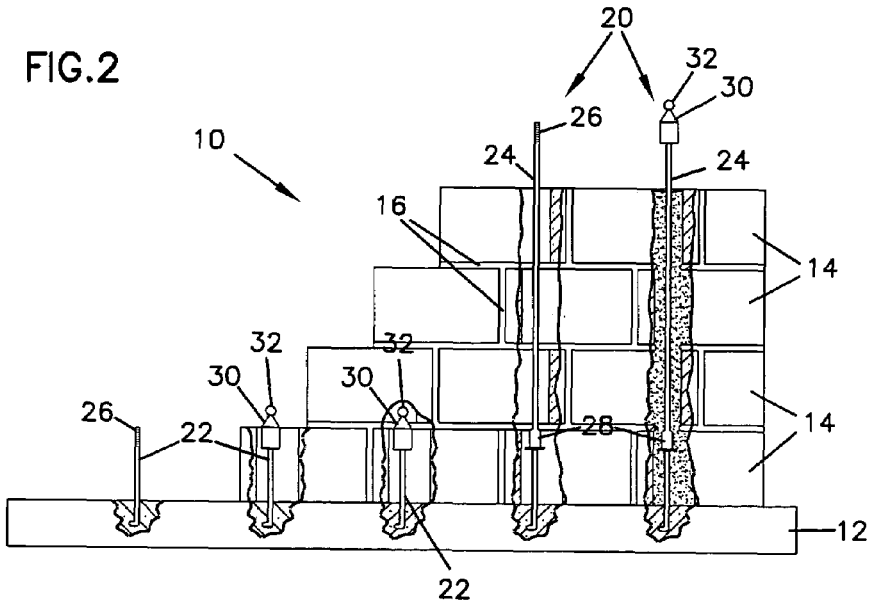
FIG. 2 is a front elevational view of a partially constructed reinforced masonry wall with portions broken away according to the principles of the present invention.

Referring now to FIG. 2, there is shown a reinforced masonry wall, generally designated 10. The wall 10 is set on a foundation 12 and includes stacked masonry blocks 14 forming the wall structure 10. The masonry blocks 14 are offset from one another in a conventional manner between adjacent layers to deter the propagation of cracks. Mortar 16 is generally placed between the blocks 14 to provide a bonding force and to seal the wall. The wall system 10 also includes a reinforcement system, generally designated 20.

The construction of the wall 10 and the steps involved in placing the reinforcement system 20 are shown at various stages in FIG. 2. The beginning stage is shown at the left, while the most advanced stage is shown on the right with intermediate stages of construction generally advancing from left to right. The reinforcement system 20 includes base reinforcement members such as rebar members 26 that are generally "L" shaped and set into the foundation 12 so that a secure footing is achieved. The upper ends of the base reinforcement members 22 have male threads in the embodiment shown. However, as those skilled in the art can appreciate, other conventional connection configurations might also be utilized.

After the foundation reinforcement member 22 is set, a cover member 30 is placed over the upper end to cover the threaded end portion 26. The cover 30 includes an open bottom portion to receive the upper end of reinforcement members and also includes a hook or eyebolt type engagement member suitable for insertion of a hook for removal, as explained hereinafter. The cover 30 protects the threaded portion 26 from falling mortar during construction of the wall. In this manner, the threads are kept clean so that a complementary member may be easily attached, as explained hereinafter. After the cover 30 has been placed on the base reinforcement member 22, construction of the wall may occur over the base reinforcement members 22. It can be appreciated that in a preferred embodiment, the base reinforcement member 22 extends outward from the foundation 12 at a height approximately the same as the height of a masonry block 14, but less than the height of two masonry blocks. In this manner, additional blocks 14 do not need to be lifted over the elevated upper ends of reinforcement members utilized in the prior art, such as shown in FIG. 1. Construction of the masonry wall 10 continues over the reinforcement member 22 until a further reinforcement member will be connected.

Figure 3:
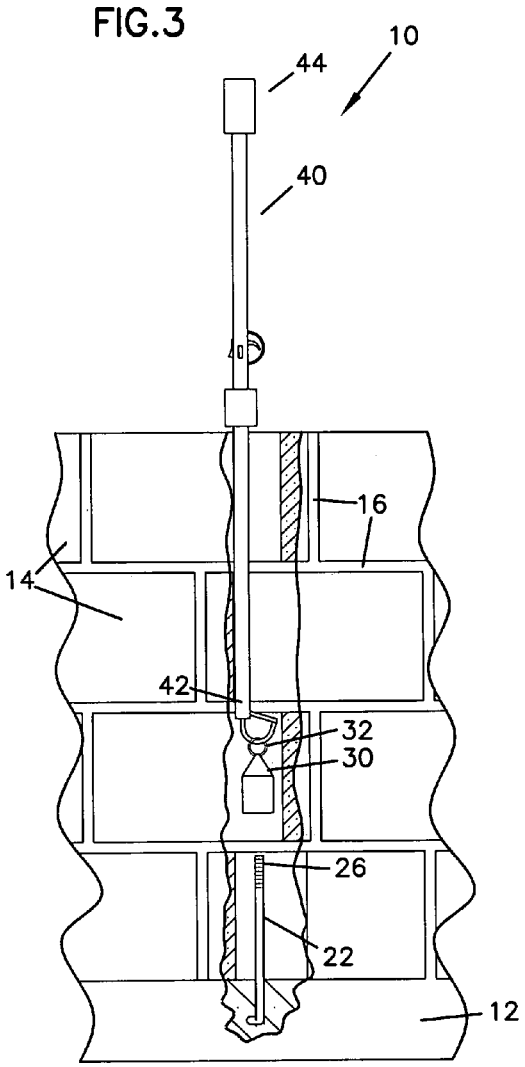
FIG. 3 is a front detail view of the partially completed wall shown in FIG. 3 with a portion broken away and a removal tool capturing a cover.
Figure 4:
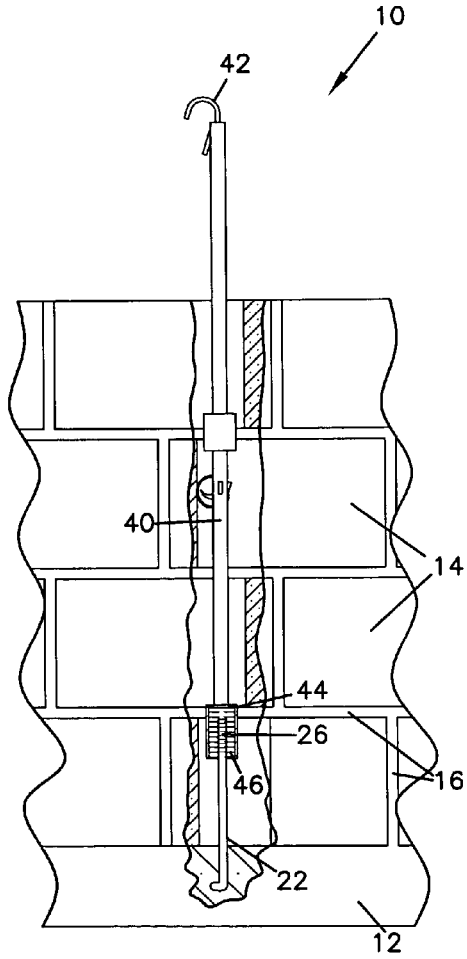
FIG. 4 is a front detail view of the partially completed wall shown in FIG. 3 with a portion broken away and a cleaning tool engaging the upper end of a rebar base member.
Figure 6:
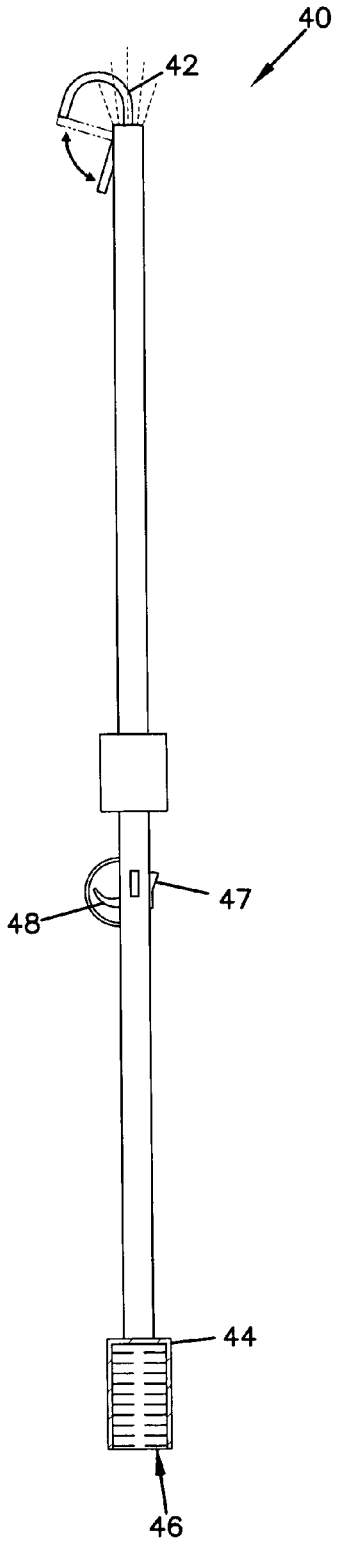
FIG. 6 is a side view of a cap lifting and rebar cleaning tool.

When the wall 10 has reached a height wherein an elongated reinforcement member 24 should be connected to the base member 22, as shown in FIG. 2, the cover 30 must be removed. As shown in FIGS. 3, 4 and 6, a cleaning and removal tool 40 or separate tools may be utilized. As shown in FIG. 6, the tool 40 has an extendable long handle and includes a removal hook 42 at one end. The hook 42 may include a closure portion actuated by a trigger 48 that closes the hook when engaging a cover 30, as shown in FIG. 3 and in phantom in FIG. 6. Releasing a lock, shown just above the trigger 48 in FIG. 6, allows the tool 40 to telescope while actuating the lock sets the tool 40 at a desired length. A cleaning brush 44 is fitted to the opposite end of the tool 40. The brush 44 includes an opening to engage the threaded portion 26. Wire bristles 46 extend inward so that the brush 44 is moved back and forth over the threaded portion 26 to clean any mortar that may have fallen onto the threaded portion after the cover 30 is removed. The tool 40 may also include a light at the end of the tool 40 to help a user see down the dark inner portions of the wall 10. As shown in FIG. 6, the light may be formed into the end of the tool shaft and includes a switch 47.

The wall 10 is configured such that the vertical openings in the masonry blocks 14 are aligned to receive elements of the reinforcing system. Therefore, the tool 40 may be inserted through the aligned openings to reach the covers 30. The hook 42 is inserted through the engagement portion 32 and the closure portion closed. The cover 30 is simply lifted off and pulled up and out the top of the wall 10. As the construction and placement of mortar has already occurred, the cover intercepts any fallen mortar, while the threaded end 26 of the base reinforcement member 22 is kept clean. As a further safeguard, the threads may also be cleaned prior to placing the reinforcement member 24 on the base reinforcement member 22. The brush 44 on the tool 40 or a separate brush tool may be utilized.

Figure 5:
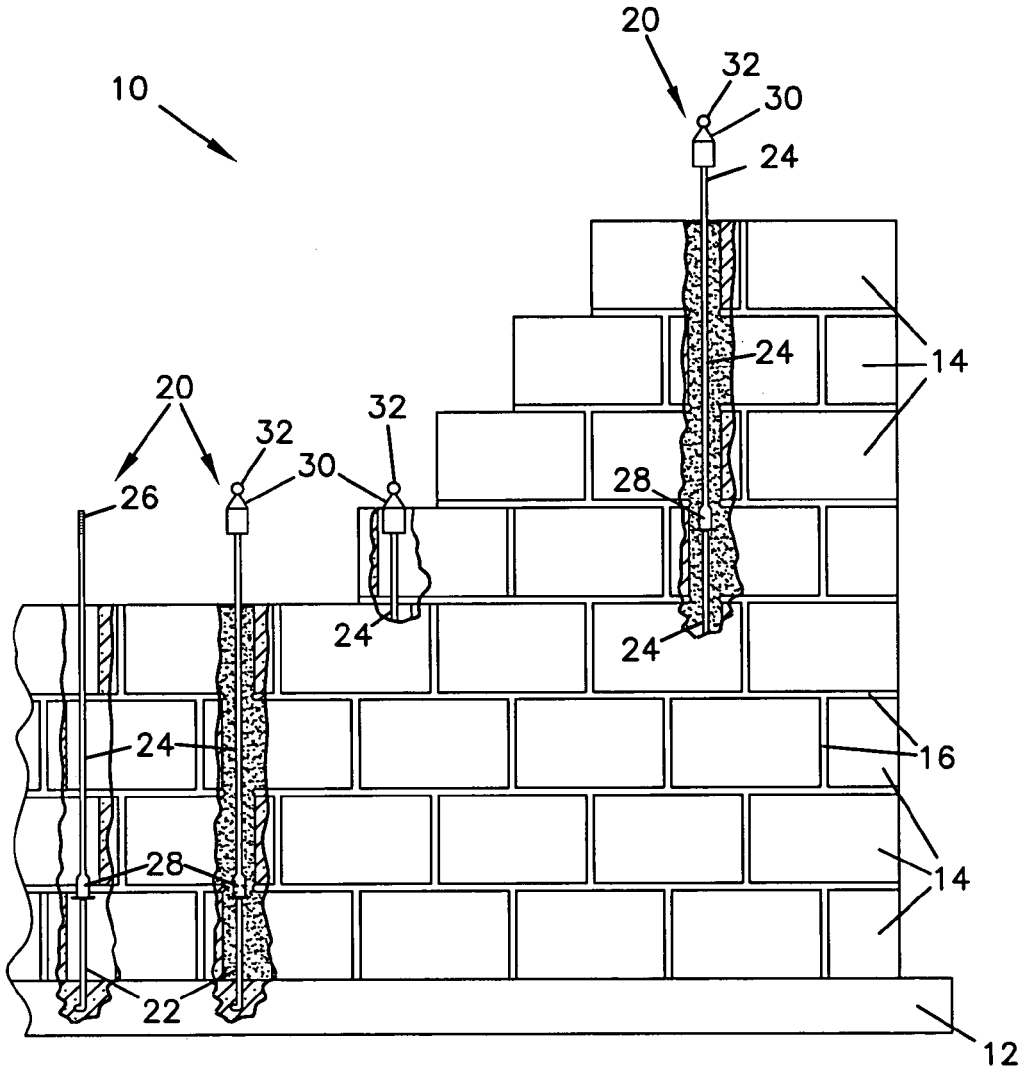
FIG. 5 is a front elevational view of a partially completed wall with a second level of rebar members being attached.
Figure 7:
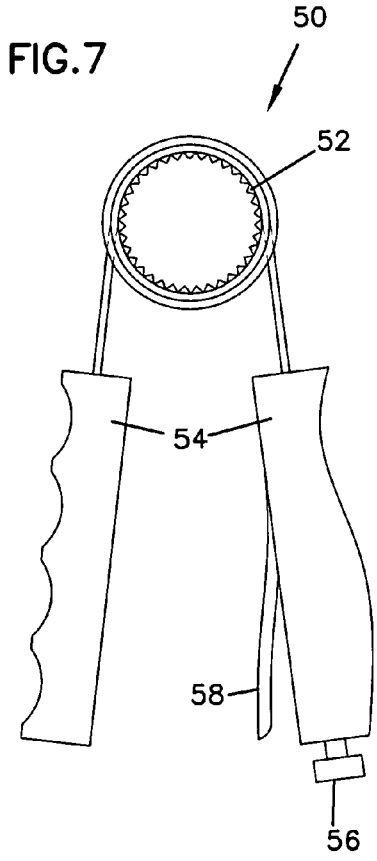
FIG. 7 is a top view of a rebar gripping tool.

Once the cap 30 has been removed and the end 26 cleaned, the elongated reinforcement member 24 is connected to the foundation member 22. The elongated member 24 includes a male threaded end 26 and a complementary female end 28. Therefore, the elongated member 24 may simply be screwed onto the threaded portion 26. As shown in FIG. 7, a gripping tool 50 may be utilized to aid in twisting the reinforcement member 24 onto the base reinforcement member 22. The gripping tool 50 includes a gripping portion 52, which has an opening configured to slide over and engage an end of the reinforcement member. A hand grip portion 54 allows a worker to close the engagement portion 52 onto the reinforcement member 24. The gripping tool 50 also includes a lock portion 58 and adjustment portion 56 that provide for securely attaching the gripping tool 50 to the reinforcement members 24 and for easily releasing and removing the tool 50 when the reinforcement members 24 are securely attached. It can be appreciated that with the present invention, the removal of the cover 30, the cleaning of the threaded end 26 and attachment of the elongated reinforcement member 24 occur without any undue lifting or reaching on the part of the workers. As shown in FIGS. 2 and 5, once the reinforcement members 24 have been attached, suitable fill material, such as concrete core fill, may be put into the open portions blocks 14 to further strengthen the wall 10 and hold the reinforcing members 24 in place.

Referring to FIG. 5, it can be appreciated that the present invention is not limited to a system and method for adding only a single layer of elongated member reinforcement members 24 to a wall. Multiple members may be connected in a vertically extending end-to-end threaded relationship to achieve a reinforced wall of greater desired height. As shown in FIG. 5, the upper threaded ends 26 of placed reinforcement members 24 are protected by the cover 30 while additional layers of masonry blocks 14 are added above the top of the elongated reinforcement members 24, which preferably extend upward approximately the same amount as the height of a masonry block 14 above the top of the partially completed wall. No undo lifting over an elevated end of a reinforcement member 24 is necessary. When the wall 10 has reached a height wherein the next level of reinforcement members 24 should be added, the cover 30 is removed and the ends 26 cleaned in the same manner as shown in FIGS. 3 and 4 and an additional reinforcement member 24 is connected. Further members 24 may be added using the same method to obtain a reinforcement system 20 of multiple vertically connected reinforcing members 24.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of installing reinforcements in a masonry wall, comprising:

constructing a base;

inserting a first reinforcement element into the base with a portion extending from the base;

resting a cover member over an upper end of the portion of the first reinforcing element extending from the base, wherein the cover member has an upper portion no wider than a lower portion;

constructing a wall of masonry blocks above the first reinforcement element, wherein each of the masonry blocks has a vertical opening formed there through and at least a portion of the vertical openings of the masonry blocks above the first reinforcement element are aligned in the masonry wall;

removing the cover member from the first reinforcing element up through the aligned vertical openings in the masonry wall; and attaching a second reinforcement element to the first reinforcement element.

2. A method according to claim 1, wherein the masonry blocks have a first height and wherein the first reinforcement element extends upward from the foundation a distance approximately the same as the first height.

3. A method according to claim 1, wherein each of the masonry blocks has a vertical opening formed there through and wherein the first and second reinforcement elements extend through the vertical openings.

4. A method according to claim 1, wherein the first and second reinforcement elements are threadably connected.

5. A method according to claim 4, wherein attaching the second reinforcement element comprises gripping an upper end of the second reinforcement element and screwing the second element onto the first element.

6. A method according to claim 1, further comprising providing a cleaning tool and cleaning the first reinforcement element prior to connecting the second reinforcement element.

7. A method according to claim 3, further comprising providing a cleaning tool and cleaning the first reinforcement element prior to connecting the second reinforcement element, and wherein the cleaning tool comprises an elongate handle and wherein the tool is inserted through the vertical openings to the first reinforcement element.

8. A method according to claim 1, wherein the first and second reinforcing elements comprise rebar elements.

9. A method according to claim 1, wherein the base comprises concrete and wherein the first reinforcement element is inserted into the base prior to the concrete setting.

10. A method according to claim 1, wherein the first reinforcement element comprises a first portion and a second portion substantially perpendicular to the first portion.

11. A masonry wall reinforcement installation system, the masonry wall having a base and a plurality of masonry blocks, each masonry block having a vertical opening formed there through, wherein at least a portion of each of the vertical openings of the masonry blocks is aligned with a portion of other of the vertical openings in the masonry wall, the system comprising:

a first reinforcement element mounted to the base and configured for inserting into the vertical opening of one of the masonry blocks;

a removable cover member covering an upper end of the first reinforcing element, wherein the cover member has a maximum width less than a minimum width of the aligned portions of the vertical openings of the masonry blocks and is configured for lifting through the aligned vertical openings of the masonry blocks;

an elongate second reinforcement element configured for extending through the vertical openings of a plurality of the masonry blocks and connecting to the first reinforcement element when the cover member is removed.

12. A system according to claim 11, wherein the masonry blocks have a first height and wherein the first reinforcement element extends upward from the foundation a distance approximately the same as the first height.

13. A system according to claim 11, wherein the first reinforcement element includes a treaded portion and the second reinforcement element includes a complementary threaded portion.

14. A system according to claim 11, further comprising a cleaning device for cleaning the first reinforcement element.

15. A system according to claim 11, further comprising a cleaning device and elongate handle configured for extending through the vertical openings of the plurality of masonry blocks and cleaning the first reinforcement element.

16. A system according to claim 15, wherein the cleaning device comprises a brush portion.

17. A system according to claim 11, wherein the first and second reinforcing elements comprise rebar elements.

18. A system according to claim 11, wherein the base comprises concrete and wherein the first reinforcement element is set into the concrete base.

19. A system according to claim 11, wherein the first reinforcement element comprises a first portion and a second portion substantially perpendicular to the first portion.

20. A system according to claim 13, wherein the engagement device comprises a gripping tool for gripping an upper end of the second reinforcement element.

21. A masonry wall reinforcement installation system, the masonry wall having a base and a plurality of masonry blocks, wherein each of the masonry blocks has a vertical opening formed there through, and wherein portions of the openings are aligned in the masonry wall, the system comprising:

a first reinforcement element set in the base having a first portion and a second portion substantially perpendicular to the first portion and configured for inserting into the vertical opening of one of the masonry blocks, wherein the first reinforcing element comprises a threaded section;

an elongate second reinforcement element having a complementary threaded portion and configured for extending through the vertical openings of a plurality of the masonry blocks and connecting to the first reinforcement element; and an engagement device for attaching to the second reinforcement element above a plurality of the masonry blocks and connecting the second reinforcement element to the first reinforcement element;

a cleaning device having an elongate handle and a brush portion configured for extending through the vertical openings of the plurality of masonry blocks and cleaning the first reinforcement element;

a removable cover member resting on and temporarily covering an upper end of the first reinforcing element, the cover member having a top portion no wider than a lower portion of cover member, wherein a maximum width of the cover member is less than a minimum width of the vertical openings aligned in the masonry wall;

a cover removal device for removing the cover member through the vertical openings in the blocks of the masonry wall.

22. A system according to claim 21, wherein the masonry blocks have a first height and wherein the first reinforcement element extends upward from the foundation a distance approximately the same as the first height.

23. A system according to claim 21, wherein the first and second reinforcing elements comprise rebar elements.

24. A system according to claim 21, further comprising an engagement device for gripping an upper end of the second reinforcement element.

25. A system according to claim 21, wherein the removal device comprises a hook element configured for engaging a complementary portion of the cover member.

26. A system according to claim 11, further comprising an engagement device for attaching to the second reinforcement element above a plurality of the masonry blocks and connecting the second reinforcement element to the first reinforcement element.

27. A method of installing reinforcements in a masonry wall according to claim 1, further comprising inserting a cover removal tool through the aligned vertical openings, engaging and directly lifting the cover member through the aligned vertical openings.

28. A system according to claim 11, wherein the cover member defines an unobstructed inner receiving chamber for receiving an end of one of the reinforcement elements.

29. A method of installing reinforcements in a masonry wall according to claim 1, wherein the removable cover member is lifted directly upward to remove the cover member from the first reinforcing element.

30. A system according to claim 11, wherein the cover member comprises an engagement element on an upper portion of the cover member configured for being engaged from above and lifted from above.

31. A system according to claim 30, wherein the engagement element defines a horizontally extending orifice formed there through.

32. A system according to claim 30, further comprising a tool configured for extending through the aligned orifices and gripping the engagement element of the cover member from above and lifting the cover member through the aligned vertical openings.

33. A system according to claim 11, wherein the cover member includes an upper portion and wherein the upper portion of the cover member is slanted.

34. A method according to claim 1, wherein the cover member includes an upper portion and wherein the upper portion of the cover member is slanted.

35. A system according to claim 11, wherein the cover member has a top portion no wider than a lower portion of cover member.

36. A method of installing reinforcements in a masonry wall, comprising:

constructing a base;

embedding a first reinforcement element into the base with a portion extending from the base and having an upper threaded end;

placing a thread protecting member over the upper threaded end of the first reinforcement element extending from the base;

constructing a wall of masonry blocks above the protect threaded end of the first reinforcement element, wherein each of the masonry blocks above the first reinforcement element has a vertical opening formed there through and wherein the vertical openings of the masonry blocks above the first reinforcement element have a portion aligned in the masonry wall to form a continuous vertical passage above the first reinforcement element;

accessing the thread protecting member and the upper threaded end of the first reinforcement element through the continuous vertical passage and exposing the upper treaded end of the first reinforcement element; and attaching a second reinforcement element inserted through the continuous vertical passage to the first reinforcement element.

37. A method according to claim 36, wherein the first reinforcing element includes an anchoring portion.

* * * * *